US006127665A

United States Patent [19]

Tatsumu

[11] Patent Number: 6,127,665

[45] Date of Patent: Oct. 3, 2000

[54] HIGH FREQUENCY HEATING APPARATUS HAVING A MECHANISM FOR PREVENTING LEAKAGE OF RADIO WAVES

[75] Inventor: Norikimi Tatsumu, Izumi, Japan

[73] Assignee: Sharp Kabushiki Kaisha, Osaka, Japan

[21] Appl. No.: 09/124,898

[22] Filed: Jul. 30, 1998

[30] Foreign Application Priority Data

Aug. 8, 1997 [JP] Japan ..... 9-214238
Apr. 30, 1998 [JP] Japan ..... 10-119834

[51] Int. Cl.[7] ..... H05B 6/76; H05B 6/78

[52] U.S. Cl. ..... 219/754; 219/738; 174/35 R

[58] Field of Search ..... 219/754, 752, 219/753, 738, 741; 174/35 GC, 35 MS, 35 R

[56] References Cited

U.S. PATENT DOCUMENTS

| | | | |
|---|---|---|---|
| 4,053,730 | 10/1977 | Baron et al. | 219/738 |
| 4,210,794 | 7/1980 | Oguri | 219/754 |
| 4,800,246 | 1/1989 | Lee et al. | 219/754 |
| 4,973,825 | 11/1990 | Hopfensperger et al. . | |
| 5,134,244 | 7/1992 | Balsells | 174/35 GC |
| 5,155,317 | 10/1992 | Lee . | |

FOREIGN PATENT DOCUMENTS

| | | | |
|---|---|---|---|
| 3224734 | 1/1984 | Germany . | |
| 61-101998 U | 6/1986 | Japan . | |
| 64-19232 | 1/1989 | Japan . | |
| 64-31696 U | 2/1989 | Japan . | |
| 1-204387 | 8/1989 | Japan | 219/738 |
| 2 1-42566 | 9/1989 | Japan . | |
| 4188595 | 7/1992 | Japan . | |
| 4-320721 | 11/1992 | Japan | 219/738 |
| 25-21839 | 6/1993 | Japan . | |
| 2144959 | 3/1985 | United Kingdom . | |

*Primary Examiner*—Philip H. Leung
*Attorney, Agent, or Firm*—Birch, Stewart, Kolasch & Birch, LLP

[57] ABSTRACT

In a microwave oven, a driving motor is fitted inside a fitting member that is fixed to a cabinet. The upper part of the output spindle of the driving motor is disposed through the fitting member so as to protrude outward, and is fitted into the lower part of a linking member. The lower part of the rotary shaft of a turntable is fitted into the upper part of the linking member. The linking member is covered by a cover, and the lower part of the cover is fitted to the fitting member. On the upper part of and outside the cover, a coil spring for preventing leakage of radio waves is fitted so as to surround the rotary shaft. The coil spring is kept in close contact with the rim of a through hole formed in the bottom surface of a heating chamber. An overhang for drainage is formed in the linking member to prevent fluid from coming into contact with the output spindle.

14 Claims, 10 Drawing Sheets

HIGH FREQUENCY HEATING APPARATUS HAVING A MECHANISM FOR PREVENTING LEAKAGE OF RADIO WAVES

BACKGROUND OF THE INVENTION

1. Field of the Invention

The present invention relates to a high-frequency heating apparatus such as a microwave oven, and particularly to a driving mechanism such as a turntable on which a material to be heated is placed and turned.

2. Description of the Prior Art

In a high-frequency heating apparatus such as a microwave oven, a material to be heated is usually turned so that the entire material is irradiated with high-frequency radio waves as evenly as possible. The material is placed on a turntable provided in a heating chamber, and the turntable is rotated by a driving force from the output spindle of a driving motor provided outside the heating chamber. If the output spindle, which is typically made of a metal, is disposed through the bottom surface of the heating chamber, it acts as an antenna and induces the radio waves to leak out of the heating chamber, posing fire and health hazards outside the heating chamber.

To prevent such leakage of radio waves, as shown in FIG. 16, a choke 3 is formed around the output spindle 2 of the driving motor 1 so that it is placed around a through hole 6 formed in the bottom surface 5 of the heating chamber 4. This choke 3 prevents the radio waves from leaking out of the heating chamber 4. In the figure, numeral 7 represents the turntable, numeral 8 represents a driving shaft for transmitting the rotation of the output spindle 2 to the turntable 7, numeral 9 represents a roller assembly consisting of a roller and a roller support, and numeral 10 represents a cabinet.

On the other hand, Japanese Published Patent Application No. H1-42566 proposes a microwave oven in which the output spindle is made of a material having a low dielectric constant such as a resin or ceramic so that it will not induce the radio waves to leak out of the heating chamber. This microwave oven is thus free from leakage of radio waves and therefore highly safe to use despite having no choke.

These conventional high-frequency heating apparatuses, however, have the following disadvantages:

First, even if the output spindle is made of a material having a low dielectric constant, it tends to attract radio waves, so that a strong electric field is present around the through hole formed in the bottom surface of the heating chamber. Thus, there is a possibility that the radio waves leak out of the heating chamber through the through hole, with the output spindle acting as a medium. In particular, the higher the dielectric constant of the material of the output spindle, the more the radio waves leak. By contrast, the lower the dielectric constant of the material, the less the radio waves leak. This, however, increases the cost of the output spindle.

Second, providing a choke on the bottom surface of the heating chamber for the prevention of leakage of radio waves not only increases the number of necessary components, but also increases the production cost by requiring an extra step of fixing the choke on the heating chamber by welding. Moreover, the choke requires extra space below the heating chamber, and thus makes it difficult to make the cabinet as compact as possible.

Third, fluid such as juicy contents of food or water dripping down through the through hole formed in the bottom surface of the heating chamber, when brought into direct contact with the output spindle of the driving motor or other electric components, may cause irregular rotation of the driving motor or imperfect insulation.

Fourth, the turntable burdens the output spindle with a load. This increases the load to be borne by the driving motor, and thus causes irregular rotation, or necessitates reinforcement of the output spindle. In addition, as the temperature inside the heating chamber rises, the heat is conducted to the driving motor and shortens its useful life.

SUMMARY OF THE INVENTION

An object of the present invention is to provide a high-frequency heating apparatus that can suppress the leakage of radio waves out of a heating chamber despite having a simple structure.

Another object of the present invention is to provide a high-frequency heating apparatus that can prevent adverse effects of a load, heat, and fluid from a heating chamber on a driving motor.

To achieve the above objects, according to one aspect of the present invention, a high-frequency heating apparatus is provided with a cabinet with a heating chamber formed inside it to place a material to be heated in, a rotary member disposed in the heating chamber, a driving power source disposed outside the heating chamber for rotating the rotary member, and a rotary shaft disposed through the bottom surface of the heating chamber for transmitting driving power from the driving power source to the rotary member. In this high-frequency heating apparatus, to prevent leakage of radio waves, the lower portion of the rotary shaft that protrudes outward from the heating chamber is surrounded by a metal coil, such as a cylindrical coil spring or a coil spring of which two adjacent turns have different diameters. According to another aspect of the present invention, to prevent leakage of radio waves, the lower portion of the rotary shaft that protrudes outward from the heating chamber is surrounded by a metal cylinder that is formed on the top surface of the driving power source integrally therewith. These structures, despite being simple, make it possible to suppress leakage of radio waves out of the heating chamber, without requiring any special design in the bottom surface of the heating chamber.

In particular, a coil composed of a conical coil spring of which each turn has a different diameter offers a stable shielding effect against radio waves. This is because, even if such a coil is produced or assembled with inferior precision, its turns, as seen from a direction perpendicular to its center axis, always overlap with each other when it is compressed, leaving no gap available to radio waves and thereby suppressing their leakage.

The diameter of the coil spring is preferably set to be equal to or greater than the diameter of the through hole that is formed in the bottom surface of the heating chamber and through which the rotary shaft is disposed, and equal to or smaller than one fourth of the wavelength of the high-frequency radio waves used for heating. The pitch with which the wire of the coil spring is wound is preferably set to be equal to or smaller than twice the diameter of the wire. The rim of the through hole is preferably made to protrude outward as high as the height of one turn of the coil spring. These factors help increase the effect of radio-wave leakage suppression. In addition, the coil spring is securely kept in position by its own resilience throughout the use of the heating apparatus, and this helps obtain a stable shielding effect against radio waves.

According to another aspect of the present invention, to solve the problem of a load, heat, and fluid originating from the heating chamber, the lower portion of the rotary shaft that protrudes outward from the heating chamber and the output spindle are linked together with a linking member. This helps prevent adverse effects of a load, heat, and fluid from the heating chamber on the driving motor.

Specifically, by fitting the driving power source to a fitting member that is fixed to the cabinet so that the fitting member covers the top surface of the driving power source, it is possible to prevent fluid that flows out of the heating chamber from coming into direct contact with the driving power source. Moreover, by forming an overhang for drainage in the linking member, it is possible to prevent fluid that flows out of the heating chamber and down the rotary shaft from coming into contact with the output spindle. Even when fluid collects on the fitting member, if a gap is formed to drain the fluid, or a wall is formed to block the fluid, it is possible to prevent the fluid from coming into contact with the driving power source, and thus it is possible to securely prevent adverse effects of such fluid.

Moreover, by making the linking member slidable on the fitting member, it is possible to have the fitting member bear the load applied to the rotary shaft and thereby free the driving power source from the load. Since the rotary shaft and the output spindle are linked together not directly but with the linking member between them, the heat from the heating chamber is insulated by the linking member so as not to conduct to the driving power source easily.

Moreover, the driving power source is mounted on the fitting member, the output spindle is disposed through the fitting member in such a way that the upper portion of the output spindle protrudes from the fitting member and is fitted into the lower portion of the linking member, the lower portion of the rotary shaft is fitted into the upper portion of the linking member, the linking member is covered by a cover, the coil spring is fitted on the upper portion of and outside the cover, the lower portion of the cover is fitted to the fitting member, the driving power source, coil spring, cover, rotary shaft, output spindle, rotary member, linking member, and fitting member are all assembled into one unit, and the fitting member is fitted to the cabinet.

This makes the fitting of the coil spring easy, and thus makes the assembly process easy to go through. In addition, the fitting of all of the above-mentioned components is ready simply by fitting the fitting member to the cabinet. This can be done easily and permits accurate positioning of the components.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

First Embodiment

Figure 3:
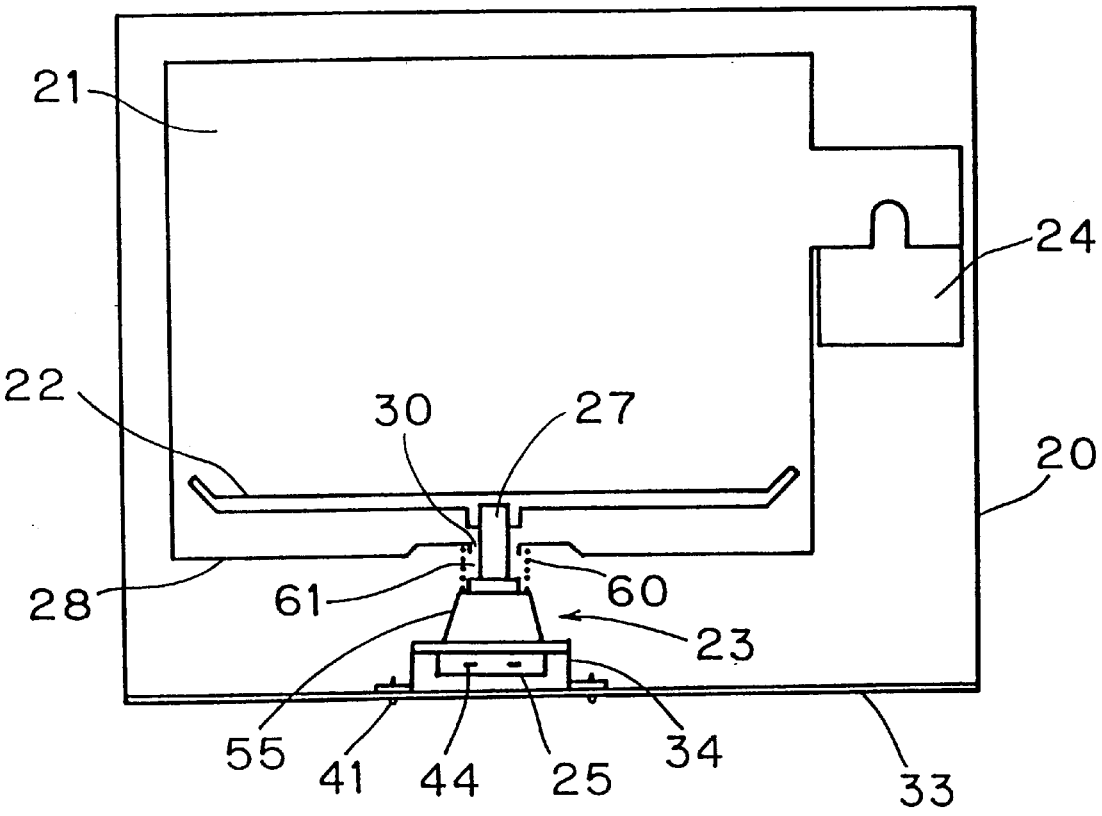
FIG. 3 is a schematic diagram showing the outline of the structure of the microwave oven of the first embodiment.

FIG. 3 shows a microwave oven embodying, as a first embodiment, the high-frequency heating apparatus of the present invention. The microwave oven has a cabinet 20, a heating chamber 21 provided inside the cabinet 20, a door for opening and closing the opening formed in the front surface of the microwave oven, a rotary member 22 provided inside the heating chamber 21 and composed of a turntable on which a material to be heated is placed and turned, a driving mechanism 23 for rotating the rotary member 22, and a magnetron 24 for feeding high-frequency microwaves into the heating chamber 21. If a heater is additionally provided inside the heating chamber 21, the microwave oven can be used not only for range heating, but also for grill heating and oven heating.

Figure 1:
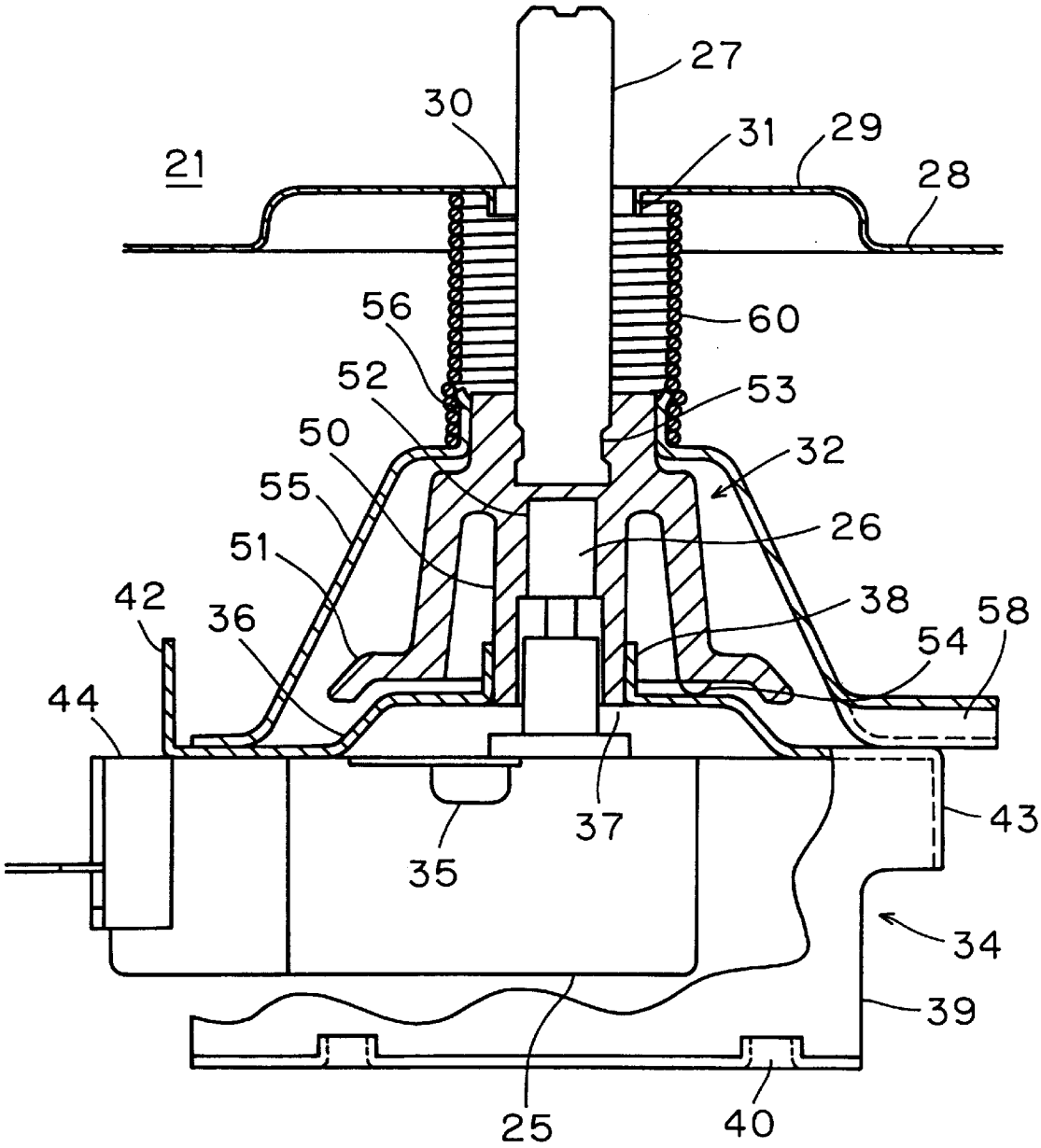
FIG. 1 is a sectional view of the driving mechanism assembly employed in the microwave oven of a first embodiment of the present invention.
Figure 2:
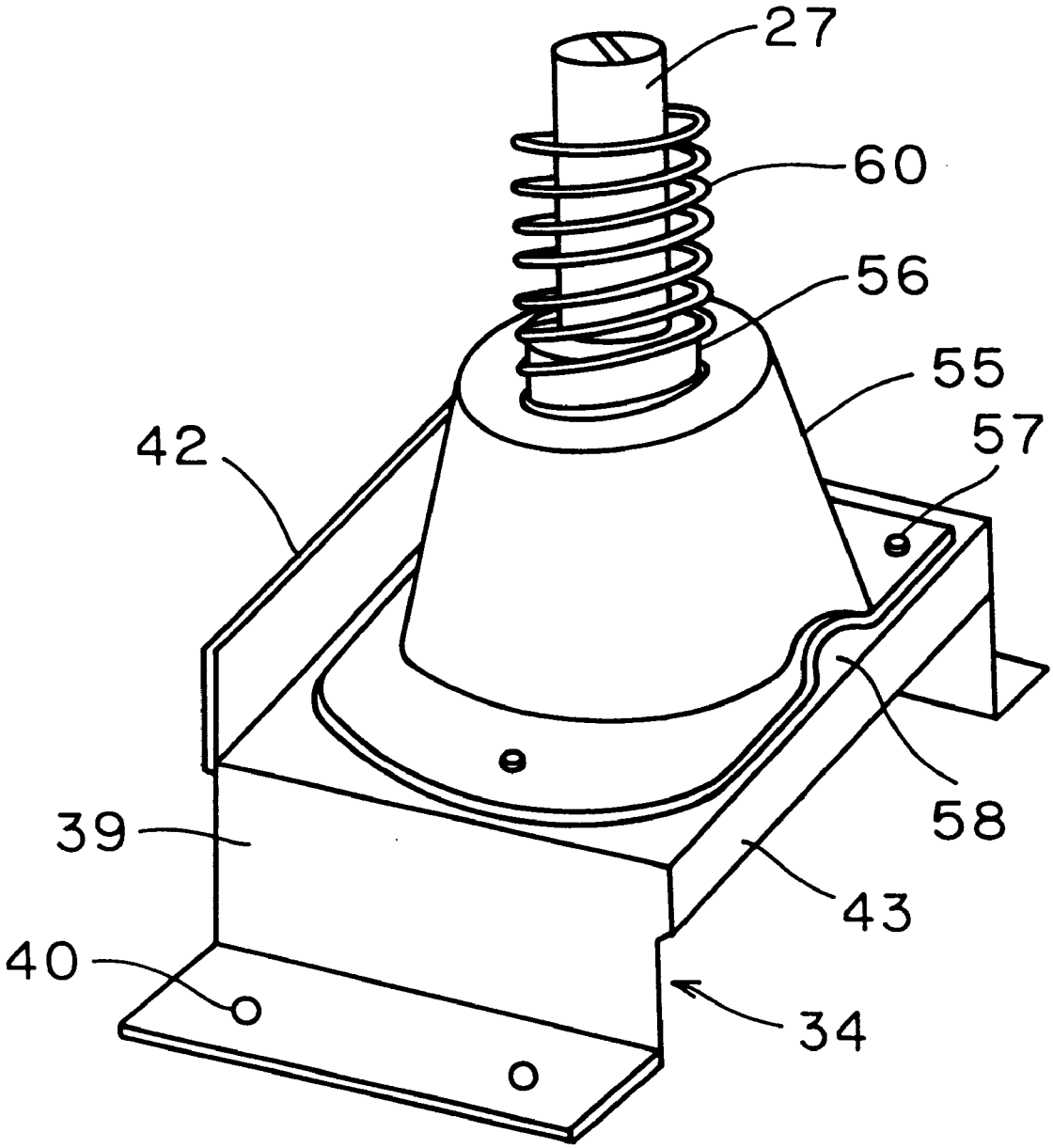
FIG. 2 is a perspective view of the driving mechanism assembly used in the microwave oven of the first embodiment.

As shown in FIGS. 1 and 2, the driving mechanism 23 has a driving motor 25 serving as a driving power source and a rotary shaft 27 made of a material having a low dielectric constant such as ceramics or synthetic resin for transmitting the driving force from the output spindle 26 of the driving motor 25 to the rotary member 22. The rotary member 22 is detachably engaged with the upper portion of the rotary shaft 27. The rotary shaft 27 may be made of a metal.

The heating chamber 21 has, at the center of its bottom surface 28, a raised portion 29, at the center of which is formed a through hole 30. The through hole 30 is formed by burring that is performed downward, so that a burr 31 is formed along the rim of the through hole 30. The rotary shaft 27 is disposed through this through hole 30 so as to protrude downward from the heating chamber 21. The driving motor 25 is disposed below the heating chamber 21, and the output spindle 26 of the driving motor 25 is linked by way of a linking member 32 to the rotary shaft 27. When the driving motor 25 is driven, the driving force is transmitted from its output spindle 26 by way of the rotary shaft 27 to the rotary member 22, and thereby the rotary member 22 is rotated.

The driving motor 25 is supported by a fitting member 34 that is fixed on the bottom plate 33 of the cabinet 20. The fitting member 34 is formed by bending, approximately in the shape of an inverted and flattened letter U. On the bottom surface of a roof portion of the fitting member 34, the driving motor 25 is fixed with a screw 35. The fitting member 34 has a raised portion 36 formed on its top surface and has a hole 37 through which the output spindle 26 is disposed. Along the rim of the hole 37 is formed a hub 38. As a result, the driving motor 25 has its upper portion covered by the fitting member 34, and is kept out of direct contact with the bottom plate 33 of the cabinet 20.

The fitting member 34 is, at both ends, bent in the shape of the letter L to form its leg portions 39. The leg portions 39 have screw holes 40 formed by burring, so that the fitting member 34 is fixed to the cabinet 20 by being tightened with screws 41 from outside the bottom plate 33 of the cabinet 20.

Moreover, the fitting member 34 has, at one of its open sides, an upper wall 42 that extends upward, and has, at the other of its open sides, a lower wall 43 that extends downward. The driving motor 25 is fitted with its power terminal block 44 facing that side of the fitting member 34 at which the upper wall 42 is formed.

The linking member 32 has a main portion 50 for engaging with the output spindle 26 and with the rotary shaft 27. An overhang portion for drainage is formed around the main portion 50 and extends like an umbrella. The linking member 32 is formed in a predetermined shape by resin molding. The main portion 50 is, in its lower portion, fitted inside the hub 38 formed in the fitting member 34 so as to be supported slidably.

The main portion 50 has a circular bore 52 formed in its lower portion. The bore 52 is divided into two portions: a portion having a diameter larger than the diameter of the output spindle 26 and a portion having a diameter equal to the diameter of the output spindle 26. The upper portion of the output spindle 26 is cut so as to have a D-shaped or cross-shaped section, and part of the bore 52 is formed in a similar shape, so that the output spindle 26 is linked to the bore 52 by inserting the former into the latter. This allows the driving force of the driving motor 25 to be transmitted to the linking member 32. The main portion 50 has a circular bore 53 also in its upper portion. The lower portion of the rotary shaft 27 is fitted into this bore 53. The linking member 32 is resin-molded around the rotary shaft 27 so that the latter will not come out of the former.

The overhang portion 51 for drainage is formed in the middle portion of the main portion 50 so as to extend outward therefrom, and the lower end of the overhang portion 51 is so shaped as to fit the raised portion 36 of the fitting member 34. This allows fluid contents of food, such as water, milk, coffee, or soup, dripping down through the through hole 30 along the rotary shaft 27 to be drained along the upper portion of the main portion 50 and then along the overhang portion 51. The fluid thus drips onto the top surface of the fitting member 34, but, since the driving motor 25 is covered by the fitting member 34, the fluid is kept out of direct contact with the driving motor 25 and its drips are kept away from the output spindle 26 and from the hole 37 of the raised portion 36. In this way, it is possible to prevent the fluid from flowing along the output spindle 26 into the driving motor 25. This helps prevent irregular rotation of the driving motor 25 and imperfect insulation.

Moreover, at the lower end of the overhang portion 51, hemispherical projections 54 are arranged at regular intervals along a circle. The projections 54 are kept in contact with the raised portion 36. When, as the output spindle 26 rotates, the linking member 32 rotates, the projections 54 slide on the fitting member 34. Thus, the linking member 32 is supported by the fitting member 34, and therefore the load applied to the rotary shaft 27 is not borne by the output spindle 26 but, by way of the linking member 32, by the fitting member 34. This not only reduces the load to be borne by the driving motor 25 and thus leads to stable rotation of the rotary member 22, but also helps reduce trouble in the driving motor 25 and thus leads to increased reliability.

The linking member 32 is covered by a cover 55. The cover 55 has the shape of a truncated cone, and its upper portion is formed into a tubular sleeve portion 56 extending upward, into which the upper portion of the main portion 50 is rotatably fitted. The lower portion of the cover 55, which extends outward, is kept in close contact with the top surface of the fitting member 34, and is fixed thereon with screws 57.

The part of the lower portion of the cover 55 that faces that side of the fitting member 34 at which the lower wall 43 is formed is curved into an arch-like shape so that a gap 58 is formed between the cover 55 and the top surface of the fitting member 34. Alternatively, it is also possible to form a groove on the top surface of the fitting member 34 so that a gap is formed between the cover 55 and this surface. This gap 58 is for draining the fluid that has dripped from the overhang portion 51 and collected on the fitting member 34. The fluid is drained through this gap 58 so as to drip onto the bottom plate 33 of the cabinet 20.

In this way, dripping fluid is carefully kept out of contact with electrical components and from the driving mechanism 23. Even in case the fluid that has dripped onto the fitting member 34 approaches the power terminal block 44 of the driving motor 25, it is blocked by the upper wall 42, and thus it is never permitted to drip onto the power terminal block 44. On the other hand, while fluid is drained through the gap 58 formed on that side of the fitting member 34 at which the lower wall 43 is formed, the fluid is made to flow along the lower wall 43 and drip off therefrom so that it will not reach the driving motor 25 by flowing along the bottom surface of the roof portion of the fitting member 34. In addition, even when fluid collects on the bottom plate 33 of the cabinet 20, the driving motor 25 is never affected thereby, because it is placed away from the bottom plate 33.

Furthermore, to prevent leakage of radio waves through the through hole 30 of the heating chamber 21, a coil spring 60 serving as a metal coil is provided so as to enclose the lower portion of the rotary shaft 27 that protrudes outward from the heating chamber 21. The coil spring 60 is a cylindrical, compressed coil spring, of which the wire is wound with a diameter greater than the diameter of the through hole 30 so that a gap 61 is secured between the coil spring 60 and the rotary shaft 27.

The coil spring 60 is disposed between the upper portion of the cover 55 and the bottom surface 28 of the heating chamber 21, with the lower portion of the coil spring 60 closely fitted around the sleeve portion 56 that has almost the same diameter as the coil. The coil spring 60 is so designed that its height in its free state is greater than the distance between the upper portion of the cover 55 and the bottom surface 28 of the heating chamber 21. As a result, when fitted, the coil spring 60 is brought into a compressed state, and thus the upper end of the coil spring 60 is brought into close contact with the bottom surface 28 of the heating chamber 21 and the lower end of the coil spring 60 is brought into close contact with the upper portion of the cover 55. Against this cover 55, the coil spring 60 is kept in position by the action of its own resilience even when the rotary shaft 27 and the linking member 32 rotate. This helps keep the coil spring 60 in a fixed position and thereby achieve a stable shielding effect against radio waves.

The sleeve portion 56 is, at its upper end, slightly bent outward so that, when the coil spring 60 is preliminarily fitted on the sleeve portion 56 in the assembly process, it will not come off easily. This makes the assembly of the coil spring 60 easy.

Thus, against the radio waves induced by way of the rotary shaft 27 so as to radiate out of the heating chamber 21 and the radio waves leaking out of the heating chamber 21 through the through hole 30, the coil spring 60 exerts a shielding effect, attenuating the radio waves within the gap 61. The closer the wire of the coil spring 60 is wound, the more effectively the radio waves are shielded.

Moreover, although the coil spring 60 is kept in contact with the bottom surface 28 of the heating chamber 21, the contact area is small. As a result, less heat is conducted from the bottom surface 28 as compared with the conventional structure in which a choke is provided. In particular, where a heater is provided in the conventional structure, as the temperature of the heating chamber 21 rises, the heat conducts to the driving motor 25, and thus raises the temperature of the wire of the driving motor 25. By the use of the coil spring 60, it is possible to reduce the heat conducted to the driving motor 25 and thereby allow the driving motor 25 to operate in more favorable operating conditions.

In addition, the rotary shaft 27 and the output spindle 26 of the driving motor 25 are linked together not directly but with a linking member 32 made of a resin between them. Accordingly, the heat from the rotary shaft 27 conducts to the linking member 32 but does not conduct easily to the output spindle 26. Moreover, the heat radiated from the heating chamber 21 can also be shut off by the fitting member 34 and the cover 55. These means of reducing the conduction of heat help reduce the heat that conducts to the driving motor 25, and thereby prevent the deterioration of the driving motor 25 and extend its useful life. In particular, by making the linking member 32 out of a highly heat-insulating material, it is possible to substantially eliminate the effect of heat on the driving motor 25.

Figure 4:
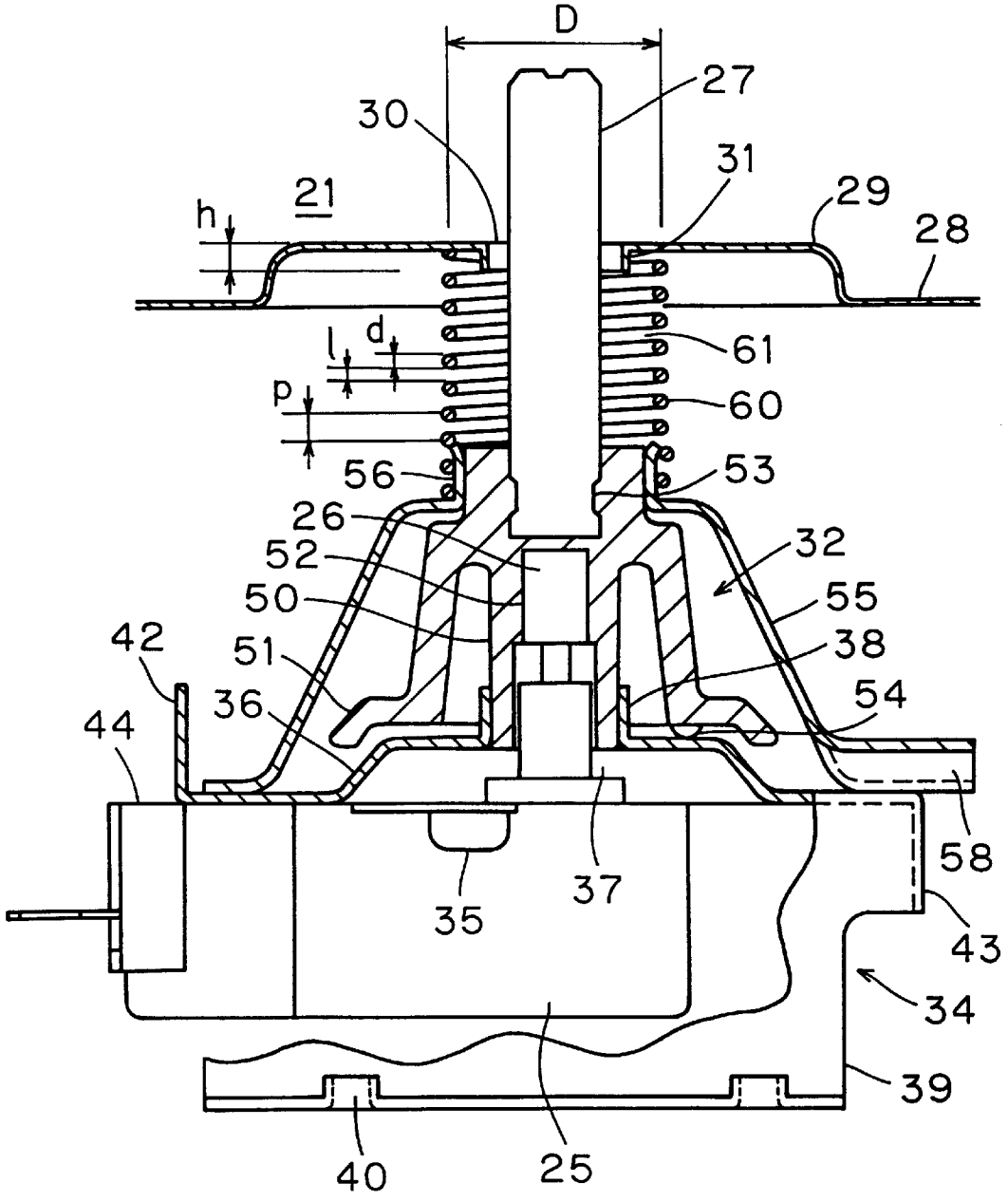
FIG. 4 is a sectional view of the driving mechanism assembly shown in FIG. 2, illustrating its state when the coil spring is compressed incompletely.

Even if, as shown in FIG. 4, the coil spring 60 has its wire wound with a slight gap between adjacent turns, it exerts a shielding effect. In this case, however, the coil spring 60 needs to have a coil diameter D equal to or greater than the diameter of the through hole 30 but equal to or smaller than one fourth of the wavelength of the radio waves used for heating. Experimentally, it has been found that, with a coil diameter D that is smaller than one fourth of the wavelength of the radio waves, it is possible to minimize the leakage of radio waves from around the coil spring 60. Moreover, since the shielding effect becomes weaker as the gap 1 between two adjacent turns of the wire becomes greater, it is preferable that the wire of the coil spring 60 be wound with a pitch p that is equal to or smaller than twice the diameter d of the wire. Furthermore, since the shielding effect becomes stronger as the burr 31 formed around the through hole 30 becomes higher, it is preferable that the height h of the burr 31 be greater than the height of one turn of the wire of the coil spring 60.

Considering these factors, it would be understood that the metal coil used to prevent leakage of radio waves does not necessarily have to be a spring having resilience, but may be simply a metal wire wound helically. Alternatively, it may even be a plurality of rings arranged along the axis and linked together with no gap, or with a gap at intervals determined as described above, between one another.

The driving mechanism 23 is assembled in the following manner. First, the fitting member 34 is fitted to the driving motor 25 with the screw 35. Then, the output spindle 26 of the driving motor 25 is fitted into the bore 52 of the linking member 32 that is formed integrally with the rotary shaft 27, and the main portion 50 is inserted into the hub 38 of the fitting member 34. The cover 55 is placed over the linking member 32 from above, and is fixed to the fitting member 34 with screws. Then, the coil spring 60 is fitted around the sleeve 56 of the cover 55 so as to be preliminarily fixed in position. In this way, the driving mechanism 23, the linking member 32, the fitting member 34, and the coil spring 60 are assembled into one unit.

This unit is mounted on the bottom surface 28 of the heating chamber 21. This is achieved by inserting the rotary shaft 27 of the unit into the through hole 30, and then tightening screws 41 that are screwed into tapped holes 40 in the fitting member 34 from outside the bottom plate 33 of the cabinet 20. At this time, the coil spring 60 is brought into a compressed state by being pressed against the raised portion 29 on the bottom surface 28 of the heating chamber 21.

Thus, the driving mechanism 23 can be placed in position simply by mounting the unit on the cabinet, and therefore there is no need to position the constituent components of the driving mechanism 23 individually. In addition, the unit can be assembled in a separate process, and therefore its assembly is far easier than when its components are mounted on the cabinet 20 piece by piece. This contributes to simplification of the production process.

Moreover, since, whereas the components are mounted on the bottom plate 33 of the cabinet 20, no component is mounted on the bottom surface 28 of the heating chamber 21, there is no need to form fitting holes on the bottom surface 28 to fit components thereon, or to weld fitting members on the bottom surface 28. Thus, with no holes or welded or similar parts that tend to gather rust, the bottom surface 28 of the heating chamber 21 has a better appearance and does not develop rust easily even when in contact with water vapor or the like.

Second Embodiment

Figure 5:
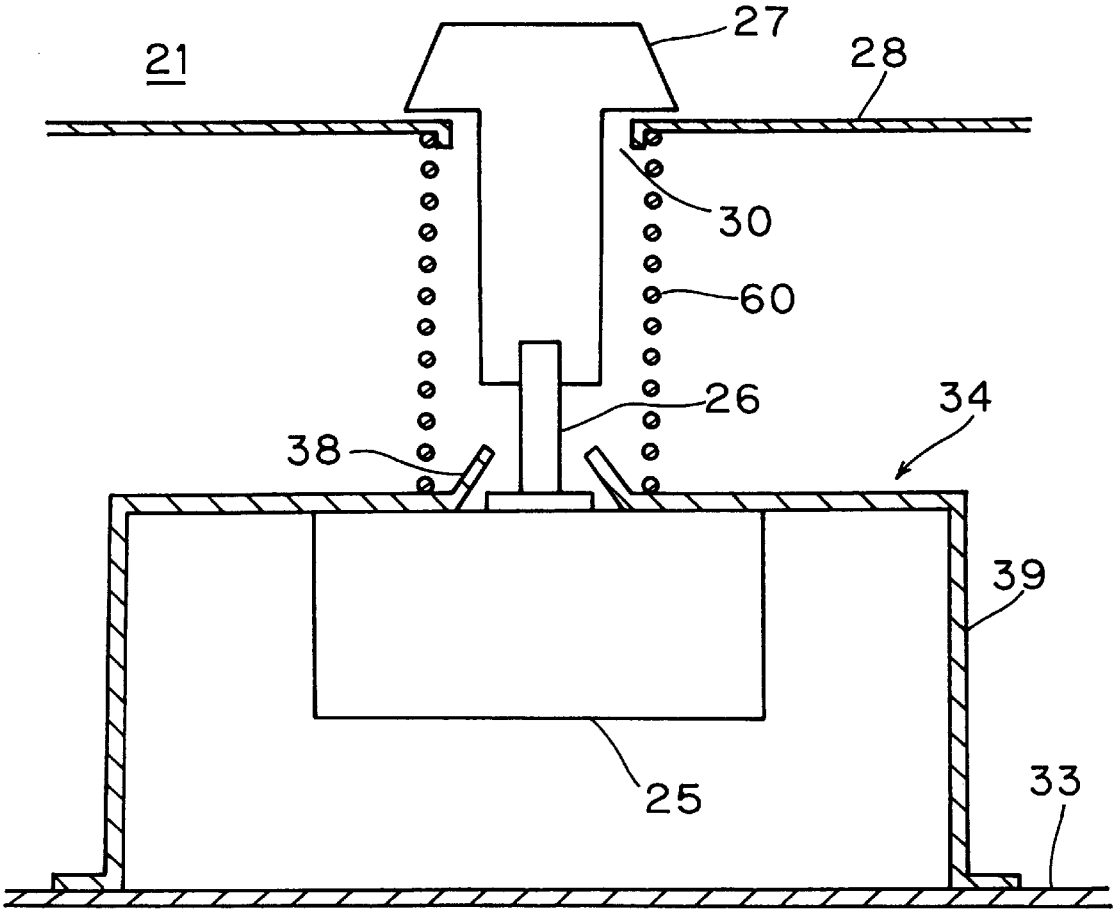
FIG. 5 is a sectional view of the driving mechanism employed in the microwave oven of a second embodiment of the present invention.

FIG. 5 illustrates the driving mechanism 23 of the microwave oven of a second embodiment of the present invention. In this embodiment, the rotary shaft 27 and the output spindle 26 are linked together directly, the driving motor 25 is mounted on the fitting member 34, and the fitting member 34 is mounted on the bottom plate 33 of the cabinet 20. The coil spring 60 is placed between the bottom surface 28 of the heating chamber 21 and the top surface of the fitting member 34 in such a way that the coil spring 60 encloses the lower portion of the rotary shaft 27 that protrudes outward from the bottom surface 28 of the heating chamber 21. The hub 38 of the fitting member 34 prevents fluid from reaching the output spindle 26. The coil spring 60 has the same shape as in the first embodiment.

Even in a structure where a gear or pulley is fixed at the lower end of the rotary shaft 27 and another gear or pulley is fixed to the output spindle 26 of the driving motor 25, with the two gears meshed together or the two pulleys linked together with a belt, it is possible to provide the coil spring 60 between the gear or pulley of the rotary shaft 27 and the bottom surface 28 of the heating chamber 21 in such a way that the coil spring 60 encloses the rotary shaft 27.

Third Embodiment

In this embodiment, to prevent leakage of radio waves, a metal cylinder is used instead of the coil spring 60. The metal cylinder typically is a flexible tube or sleeve, which has a diameter greater than the through hole 30 and is fitted around the sleeve portion 56 of the cover 55. In other respects, the driving mechanism of this embodiment has the same structure as that of the first embodiment.

Fourth Embodiment

Figure 6:
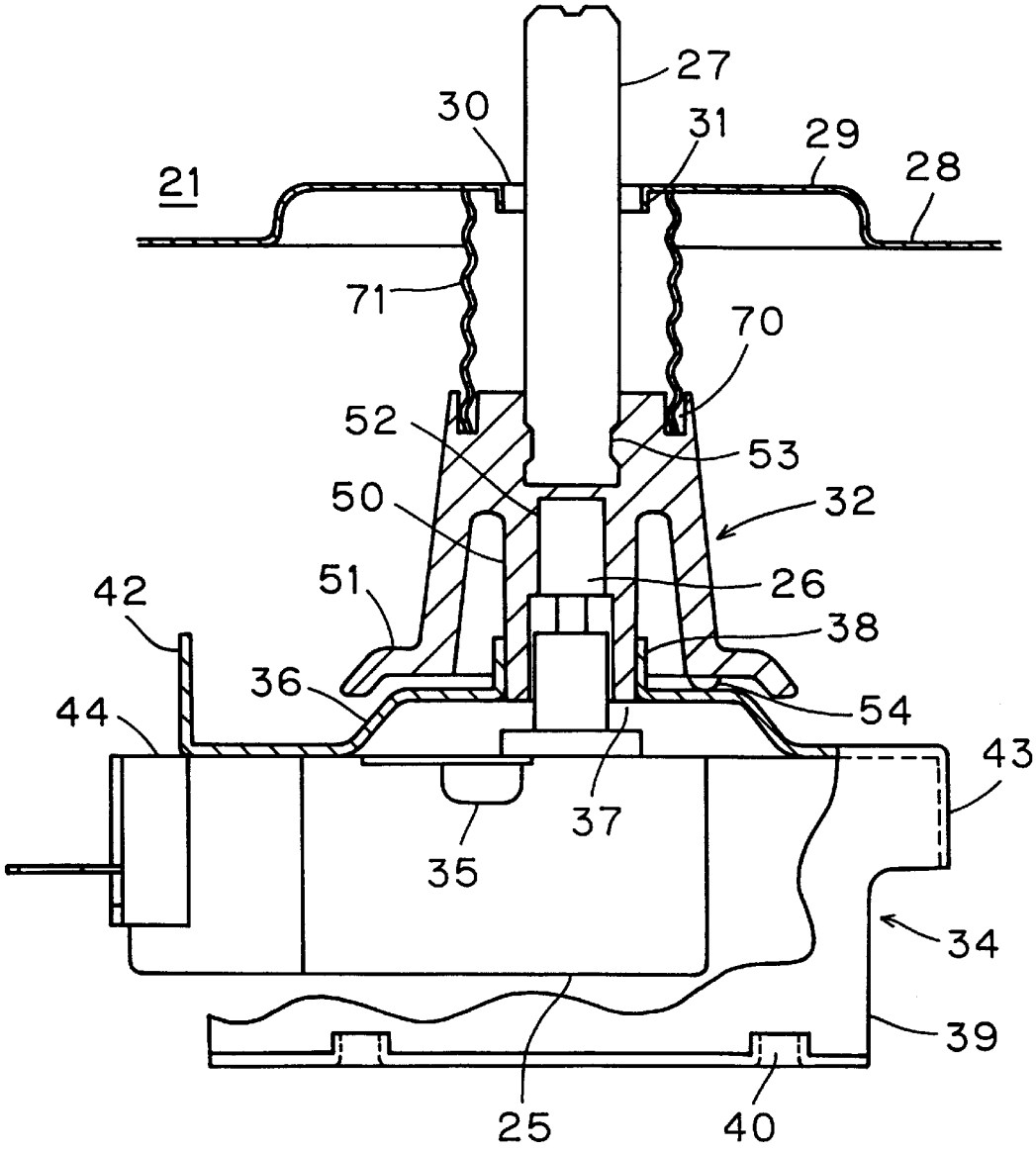
FIG. 6 is a sectional view of the driving mechanism assembly used in the microwave oven of a fourth embodiment of the present invention.

FIG. 6 shows the structure of the driving mechanism of the microwave oven of a fourth embodiment of the present invention. In this embodiment, a circular groove 70 is formed in the upper portion of the linking member 32, and the lower portion of a flexible tube 71 is inserted into this groove 70 so as to be engaged therewith. This allows the flexible tube 71 to be integrated into the driving mechanism 23. Although the upper end of the flexible tube 71 is kept in contact with the bottom surface 28 of the heating chamber 21, the flexible tube 71 can rotate by sliding on the bottom surface 28 as the linking member 32 rotates. Here, it is also possible to use a coil spring 60 in place of the flexible tube 71.

Fifth embodiment

Figure 7:
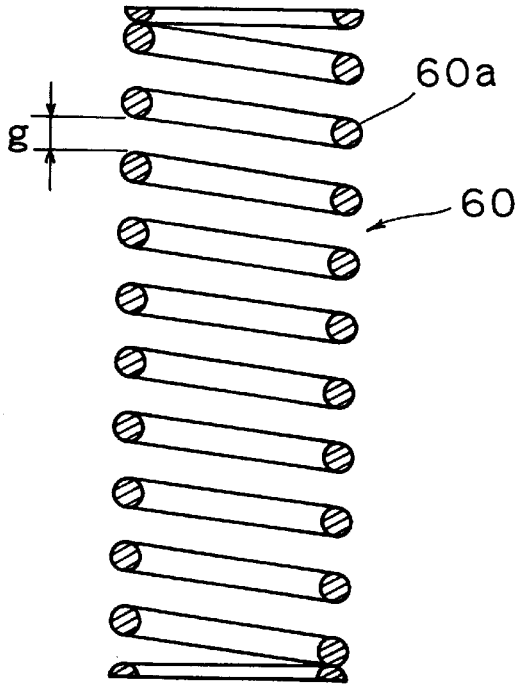
FIG. 7 is a sectional view of a cylindrical coil spring.
Figure 8A:
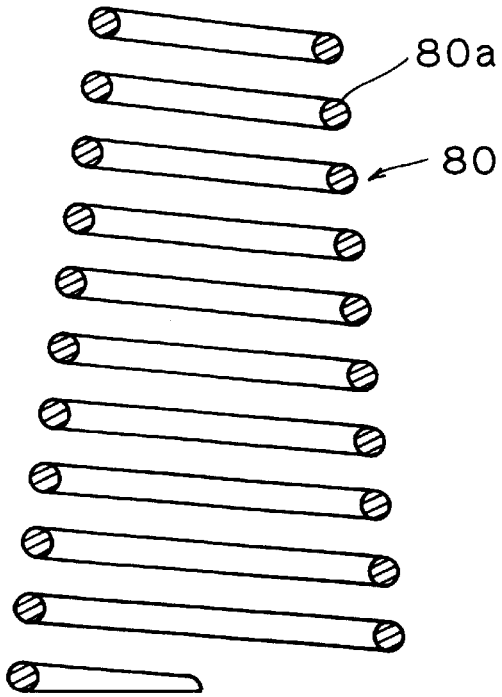
FIGS. 8A and 8B are sectional views of a conical coil spring, with FIG. 8A illustrating its free state and FIG. 8B illustrating its compressed state.
Figure 8B:
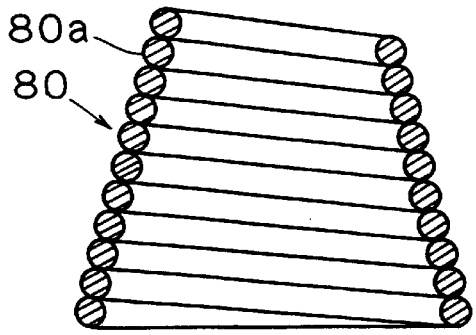

In the production and assembly of the coil spring shown in FIG. 7 and used in the previously described first embodiment, variations are inevitable in the distance (gap) g between two adjacent turns of the wire 60*a*. Variations in the gap g between turns of the wire 60*a* affect how radio waves leak from inside the coil spring 60, and it has been observed that the greater the gap g, the greater the leakage of radio waves. Accordingly, such variations may lead to an unstable shielding effect against radio waves.

To avoid this problem, in this embodiment, a coil spring 80 of which each turn of the wire 80*a* has a different coil diameter is used so that, when the coil spring 80 is compressed, adjacent turns of the wire 80*a*, as seen horizontally, overlap with each other. This metal coil spring 80 is a so-called conical coil spring having its wire 80*a* wound with a fixed pitch between turns but with decreasing coil diameters from the bottom most turn to the topmost turn.

Figure 9:
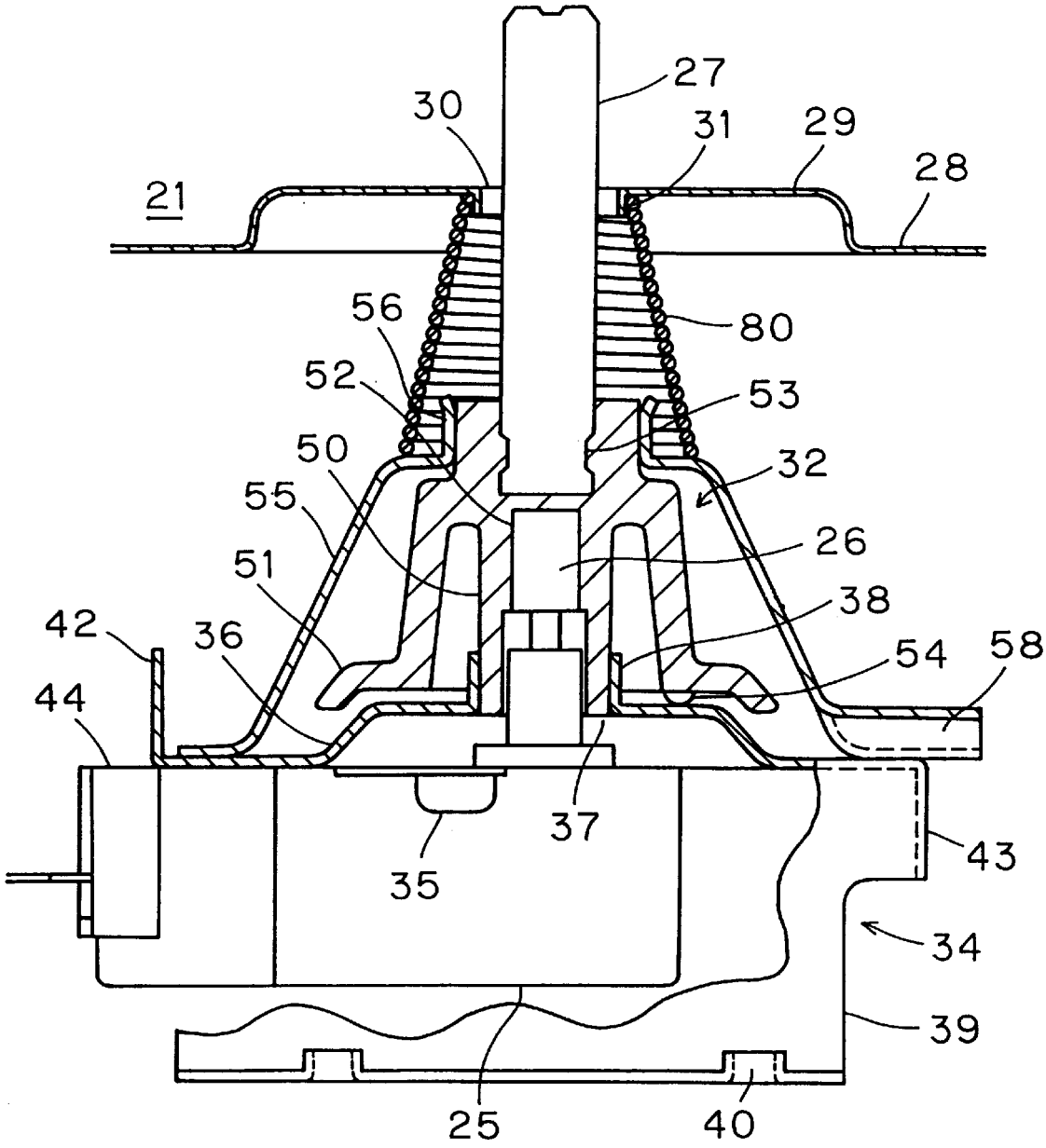
FIG. 9 is a sectional view of the driving mechanism assembly used in the microwave oven of a fifth embodiment of the present invention.

As shown in FIG. 9, this coil spring 80 is disposed between the upper portion of the cover 55 and the bottom surface 28 of the heating chamber 21. The height of the coil spring 80 in its free state is designed to be greater than the distance between the upper portion of the cover 55 and the bottom surface 28 of the heating chamber 21. As a result, when fitted, the coil spring 80 is brought into a compressed state, with its upper end brought into close contact with the lower side of the bottom surface 28 of the heating chamber 21, and with its lower end brought into close contact with the upper portion of the cover 55. In other respects, the driving mechanism of this embodiment has the same structure as that of the first embodiment.

Figure 10A:
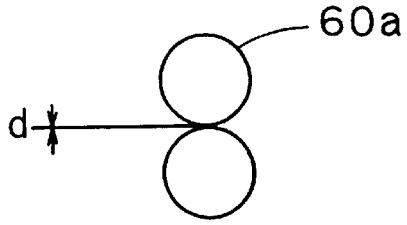
FIGS. 10A and 10B are enlarged sectional views of the wire of a cylindrical coil spring, with FIG. 10A illustrating its state when the coil is compressed and FIG. 10B illustrating its state when the coil is free.
Figure 10B:
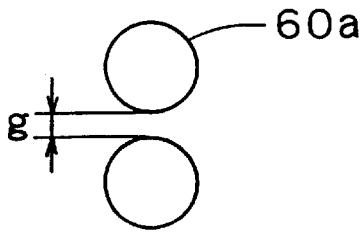

The conical coil spring 80 and the cylindrical coil spring 60 have the following differences. As shown in FIG. 10A, when the cylindrical coil spring 60 is in the compressed state, adjacent turns of the wire 60*a* are closest to, and in point contact with, each other. At this time, assuming that d represents the overlap between adjacent turns of the wire 60*a*, d=0. When the cylindrical coil spring 60 is in the free state, there is a gap g between adjacent turns as seen from a direction perpendicular to the center axis (i.e. as seen horizontally). That is, when the coil spring 60 is fitted, it is compressed, but, since variations are inevitable in the production and assembly of the components including the coil spring 60 itself, it cannot be guaranteed that every two adjacent turns of the wire 60*a* of the coil spring 60 are brought into close contact with each other, nor that the gap g is constant. Thus, it is difficult to suppress with constant efficacy the leakage of radio waves from inside the coil spring.

Figure 11A:
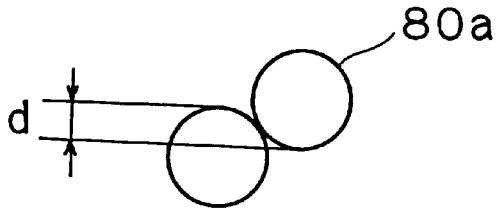
FIGS. 11A and 11B are enlarged sectional views of the wire of a conical coil spring, with FIG. 11A illustrating its state when the coil is compressed and FIG. 11B illustrating its state when the coil is free.
Figure 11B:
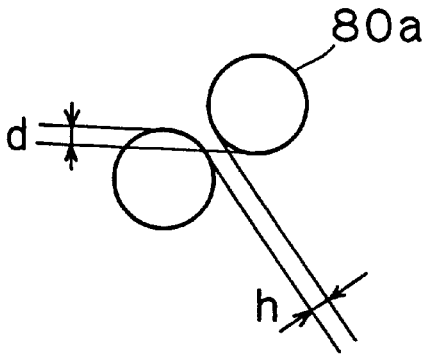

By contrast, as shown in FIG. 11A, when the conical coil spring 80 is in the compressed state, adjacent turns of the wire 80*a* are closest to, and in point contact with, each other, and, in addition, the overlap d along the center axis is far greater than in the cylindrical coil spring 60. When the conical coil spring 80 is in the free state, there is a gap h smaller than the gap g mentioned above between two adjacent turns of the wire 80*a*, but two adjacent turns of the wire 80*a*, as seen from a direction perpendicular to the center axis, overlap with each other. As a result, to radio waves, the coil spring 80 acts as a shield having no gap between adjacent turns of the wire 80*a*, and the greater the overlap d, the weaker the radio waves that leak from inside the coil spring 80.

Accordingly, by the use of the conical coil spring 80, it is possible to ensure that two adjacent turns of the wire 80*a* overlap with each other whenever the coil spring 80 is compressed even if the gap between two adjacent turns of the wire 80*a* is not constant as a result of various inevitable variations. This permits the coil spring 80 to exert a stable shielding effect against the radio waves induced by way of the rotary shaft 27 so as to radiate out of the heating chamber 21 and the radio waves leaking out of the heating chamber 21 through the through hole 30, and thereby helps reduce leakage of radio waves greatly.

Figure 12:
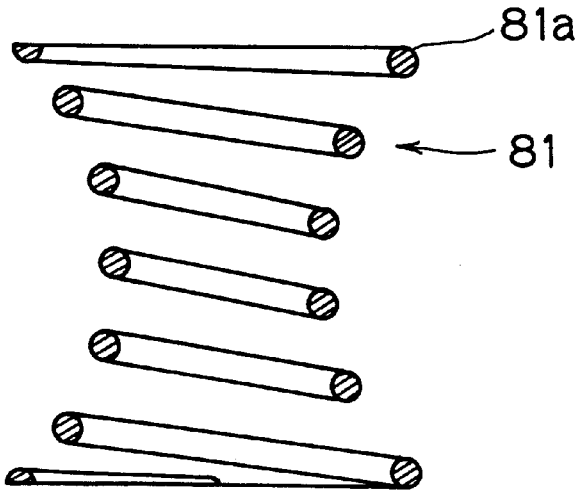
FIG. 12 is a sectional view of a pincushion-shaped coil spring.
Figure 13:
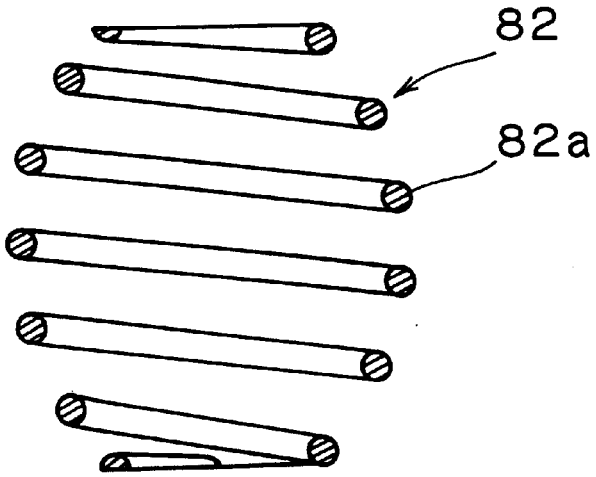
FIG. 13 is a sectional view of a barrel-shaped coil spring.
Figure 14A:
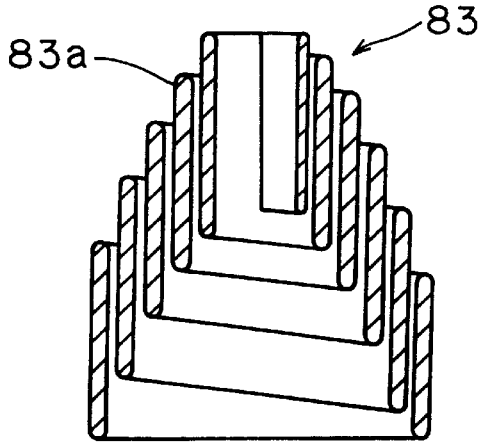
FIGS. 14A and 14B are a sectional view and a front view, respectively, of a helically wound strip spring.
Figure 14B:
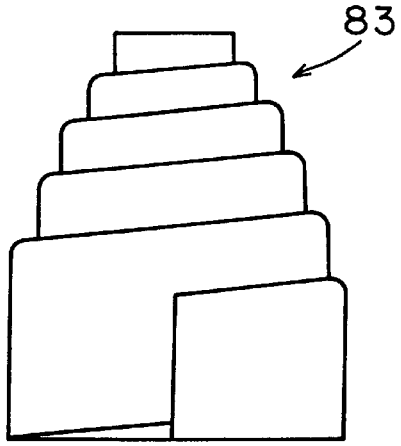
Figure 15:
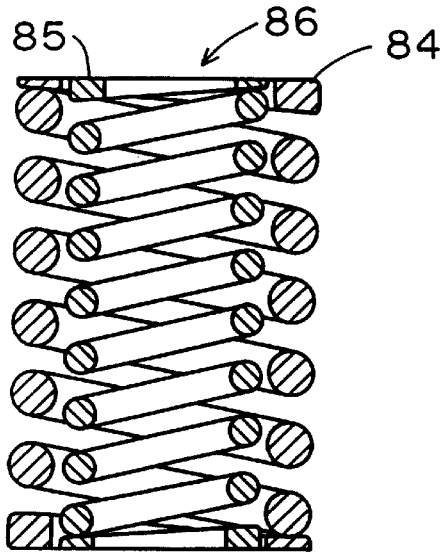
FIG. 15 is a sectional view of a double coil spring.
Figure 16:
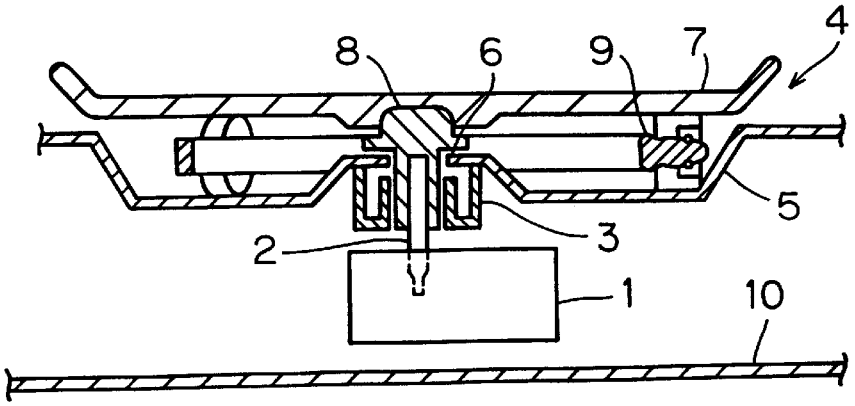
FIG.16 PRIOR ART
FIG. 16 is a sectional view of a conventional turntable and the surrounding portion.

As a coil spring of which two adjacent turns of the wire, as seen horizontally, overlap with each other, it is possible to use, instead of the above-described conical coil spring 80, a pincushion-shaped coil spring 81 as shown in FIG. 12, or a barrelshaped coil spring 82 as shown in FIG. 13. When the coil spring 81 or 82 is in the free state, two adjacent turns of the wire 81*a* or 82*a* are apart from each other; when it is fitted on the bottom surface 28 of the heating chamber 21, it is compressed, and two adjacent turns of the wire 81*a* or 82*a* overlap with each other. Alternatively, it is also possible to use a helically wound strip spring 83 as shown in FIGS. 14A and 14B, or a double coil spring 86 as shown in FIG. 15 that is composed of two cylindrical coil springs 84 and 85 having different coil diameters combined concentrically. These coil springs 83 and 86 leave no gap even in their free state, and therefore exert a superb shielding effect against radio waves.

As will be clear from the above descriptions, according to the present invention, the lower portion of the rotary shaft that protrudes outward from the heating chamber is enclosed by a metal coil or a metal cylinder. As a result, it is not necessary to provide a choke or use an expensive material having a low dielectric constant to prevent leakage of radio waves; nor is it necessary to shape the bottom surface of the heating chamber in any special way. Thus, it is possible to prevent leakage of radio waves out of the heating chamber by the use of a simple and inexpensive structure.

Moreover, by using a coil spring as a metal coil, and by fitting it in its compressed state, it is possible to prevent, by the action of the resilience of the coil spring itself, the coil spring from coming out of position while in use. This helps achieve a stable shielding effect against leakage of radio waves. In particular, when a coil spring, such as a conical coil spring, of which each turn of the wire has a different coil diameter is used as the coil spring so that, when the coil spring is fitted in its compressed state, two adjacent turns of the wire overlap with each other, it is possible to achieve a stable shielding effect against radio waves regardless of various variations inevitable in the production and assembly of the components, and thereby greatly reduce the leakage of radio waves.

Moreover, the lower portion of the rotary shaft and the output spindle of the driving power source are linked together with a linking member fitted between them, and are thereby separated from each other in terms of heat conduction. This prevents heat from conducting from the heating chamber to the driving power source, and thereby helps prevent the deterioration of the driving power source and prolong its useful life. In addition, the linking member slides on the fitting member that covers the driving power source, and therefore the load applied to the rotary shaft is borne not by the output spindle but by the fitting member. This frees the driving power source from the load, and thereby helps prevent irregular rotation and increase reliability. In addition, by fitting the metal coil around the upper portion of the cover that covers the linking member, the metal coil can be fitted easily.

Furthermore, since the top surface of the driving power source is covered by the fitting member that is fixed on the cabinet, it is possible to prevent fluid dripping from the heating chamber from coming into direct contact with the driving power source. If an overhang for drainage is additionally formed in the linking member, it is possible to prevent the fluid from flowing along the rotary shaft and reaching the output spindle, and thus prevent the fluid from entering the driving power source along the output spindle. Thus, the fluid from the heating chamber is never allowed to come into contact with the driving power source or its electrical components. This helps prevent irregular rotation and imperfect insulation, and thereby achieve stable rotation and increased reliability.

The driving power source, the metal coil, the cover, the fitting member, the linking member, the rotary shaft, and the output spindle are assembled into one unit in advance. This helps eliminate the need for extra fitting members, reduces the number of the constituent components, makes the fitting of those components to the cabinet easier, and simplifies the production process. In addition, this also helps increase fitting accuracy, makes the positioning of those components relative to the cabinet easier, and thereby effectively realizes a shielding effect against radio waves.

By additionally forming a gap for drainage between the lower portion of the cover and the fitting member, it is possible, even in case drips of fluid collect on the fitting member, to drain the fluid away from the driving power source and its electrical components, and thereby eliminate the effect of fluid.

Obviously, many modifications and variations of the present invention are possible in light of the above teachings. It is therefore to be understood that within the scope of the appended claims, the invention may be practiced other than as specifically described. For example, although the above embodiments deal only with cases where the turntable is rotated by being driven directly with a rotary shaft, the turntable may be rotated by being supported on rollers, by being placed on a rotatable stand, or by any other driving power transmission method. The rotary member is not limited to a turntable, but may be a bladed wheel for stirring or kneading a material to be heated placed in a vessel.

Moreover, in a driving mechanism where the output spindle of the driving motor is disposed through the bottom surface of the heating chamber so as to penetrate into the heating chamber, the metal coil may be so disposed as to enclose the part of the output spindle that is left outside the heating chamber.

What is claimed is:

1. A high-frequency heating apparatus comprising:

a cabinet having a heating chamber formed therein for placing a material to be heated;

a rotary member disposed in said heating chamber;

a driving power source disposed outside said heating chamber for rotating said rotary member;

a rotary shaft extending through a bottom surface of said heating chamber for transmitting driving power from said driving power source to said rotary member; and a metal coil for preventing leakage of radio waves, said metal coil surrounds a lower portion of said rotary shaft protruding outward from said heating chamber, wherein a center axis of said metal coil is generally parallel to an axis of said rotary shaft.

2. The high-frequency heating apparatus as claimed in claim 1, wherein the lower portion of said rotary shaft and an output spindle of said driving power source are linked together with a linking member.

3. The high-frequency heating apparatus as claimed in claim 2, wherein a portion of said driving power source is covered by a fitting member fixed to said cabinet, an upper portion of said output spindle is disposed through said fitting member to protrude upward therefrom, and wherein said linking member is fitted on the upper portion of said output spindle and slides on said fitting member.

4. The high-frequency heating apparatus as claimed in claim 2, wherein said rotary shaft is fitted into an upper portion of said linking member and said output spindle is fitted into a lower portion of said linking member, and wherein said linking member ha s an overhang for drainage to prevent fluid that flows out of said heating chamber and down said rotary shaft from coming into contact with said output spindle.

5. The high-frequency heating apparatus as claimed in claim 2, wherein said linking member is covered by a cover and said metal coil is fitted on an upper portion of said cover outside said cover.

6. The high-frequency heating apparatus as claimed in claim 2, wherein said driving power source is mounted on a fitting member, said spindle is disposed through said fitting member having an upper portion of said output spindle protruding from said fitting member, said upper portion of said output spindle is fitted into a lower portion of said linking member, a lower portion of said rotary shaft is fitted into an upper portion of said linking member, said linking member is covered by a cover, said metal coil is fitted on an upper portion of and on an outside of said cover, a lower portion of said cover is fitted to said fitting member, said driving power source, metal coil, cover, rotary shaft, output spindle, rotary member, linking member, and fitting member are all assembled into a single unit, and said fitting member is fitted to said cabinet.

7. The high-frequency heating apparatus as claimed in claim 6, wherein an overhang for drainage is formed in said linking member to prevent fluid that flows out of said heating chamber and down said rotary shaft from coming into contact with said output spindle, and wherein a gap for drainage is formed between a lower portion of said cover and said fitting member.

8. The high-frequency heating apparatus as claimed in claim 1, wherein said metal coil includes a coil spring having adjacent turns of different diameters, wherein when said coil spring is compressed, the adjacent turns of said coil spring, when viewed in a direction perpendicular to said center axis, overlap with each other.

9. The high-frequency heating apparatus as claimed in claim 8, wherein said coil spring is conical in shape.

10. The high-frequency heating apparatus as claimed in claim 1, wherein said heating chamber has a through hole formed in a bottom surface thereof through which said rotary shaft extends, and wherein said metal coil includes a cylindrical coil spring having a diameter equal to or greater than a diameter of said through hole and equal to or smaller than one fourth of a wavelength of a radio wave used for heating.

11. The high-frequency heating apparatus as claimed in claim 1, wherein said metal coil includes a cylindrical coil spring having a wire wound with a pitch equal to or smaller than twice a diameter of said wire.

12. The high-frequency heating apparatus as claimed in claim 1, wherein said heating chamber has a through hole formed in a bottom surface thereof through which said rotary shaft extends, and wherein a rim of said through hole protrudes from the bottom surface at least as far as a height of one turn of said metal coil.

13. The high-frequency heating apparatus as claimed in claim 1, wherein a top surface of said driving power source is covered by a fitting member fixed to said cabinet, and wherein said metal coil is fitted between said fitting member and a bottom surface of said heating chamber.

14. A high-frequency heating apparatus comprising:

a cabinet having a heating chamber formed therein for placing a material to be heated;

a rotary member disposed in said heating chamber;

a driving power source disposed outside said heating chamber for rotating said rotary member;

a rotary shaft extending through a bottom surface of said heating chamber for transmitting driving power from said driving power source to said rotary member;

a lower portion of said rotary shaft that protrudes outward from said heating chamber is surrounded by a flexible tube to prevent leakage of radio waves, said flexible tube is fitted on a top surface of said driving power source; and wherein said driving power source includes a linking member for linking the lower portion of said rotary shaft and an output spindle of said driving power source, said linking member includes a circular groove formed in an upper surface thereof for receiving an end of said flexible tube, said flexible tube is secured between a lower surface of said heating chamber and said linking member, and wherein said flexible tube is mounted for rotation with said rotary shaft.

* * * * *